United States Patent [19]

Palmer

[11] 4,176,388

[45] Nov. 27, 1979

[54] CONTROL CIRCUIT FOR A CONTACTOR

[75] Inventor: Norman H. G. Palmer, Glenfield, England

[73] Assignee: Towmotor Corporation, Mentor, Ohio

[21] Appl. No.: 891,586

[22] Filed: Mar. 30, 1978

[51] Int. Cl.[2] ..... H01H 47/18; H01H 47/32

[52] U.S. Cl. ..... 361/196; 361/22; 361/194; 361/205

[58] Field of Search ..... 361/22, 189, 194, 201, 361/205, 7, 8, 13, 196

[56] References Cited

U.S. PATENT DOCUMENTS

| | | | |
|---|---|---|---|
| 3,017,543 | 1/1962 | Hillman et al. | 361/196 |
| 3,558,977 | 1/1971 | Beaudoin | 361/13 |
| 3,639,808 | 2/1972 | Ritzlow | 361/13 |
| 3,660,718 | 5/1972 | Pinckaers | 361/22 |
| 3,774,082 | 11/1973 | Chang | 361/196 |
| 3,796,061 | 3/1974 | Weihl | 361/22 |
| 3,950,675 | 4/1976 | Weber et al. | 361/196 X |
| 4,125,885 | 11/1978 | Lowther et al. | 361/196 X |

FOREIGN PATENT DOCUMENTS

| | | | |
|---|---|---|---|
| 205905 | 3/1966 | U.S.S.R. | 361/8 |

*Primary Examiner*—J. D. Miller
*Assistant Examiner*—L. Schroeder
*Attorney, Agent, or Firm*—John L. James

[57] ABSTRACT

A control circuit is provided for a contactor which has a pair of contacts and an actuator coil which is energizable under the control of a switch to cause the contacts to close. The control circuit provides a temporary path for energizing the coil and a permanent path through the contacts. The control circuit delays energization of the coil for a preselected time to allow switch contact bounce to cease. The control circuit prevents a reestablishment of the temporary path for preselected time after the contacts close.

11 Claims, 1 Drawing Figure

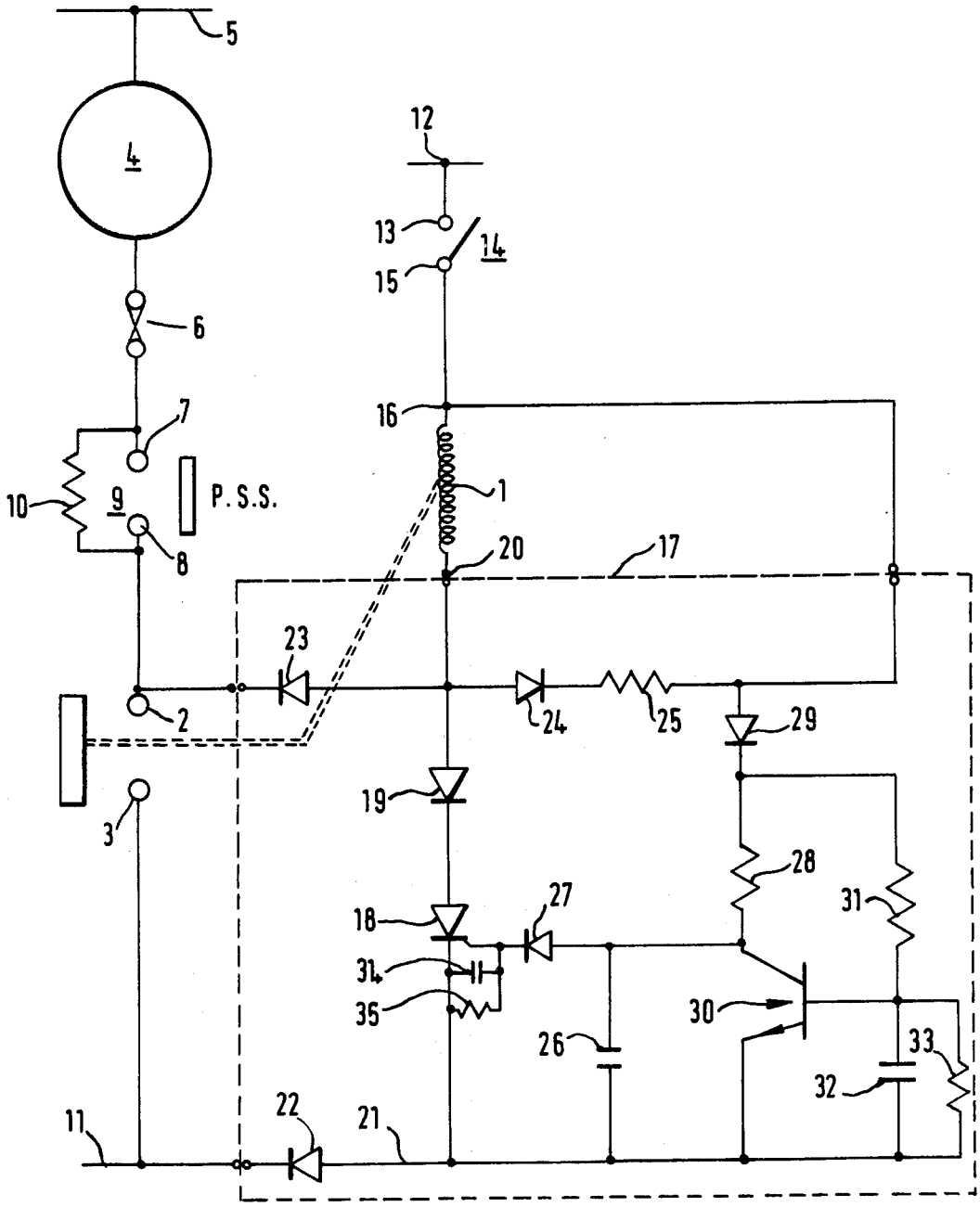
5
4
12
13
14
15
6
7
16
10
9
P.S.S.
1
8
20
17
23
2
24
25
29
19
3
28
27
31
18
34
35
30
26
33
32
11
22
21

CONTROL CIRCUIT FOR A CONTACTOR

BACKGROUND OF THE INVENTION

This invention relates to a control circuit for an electro-magnetically operated contactor which comprises one or more pairs of contacts and a solenoid which is energized by direct current to cause closure of the contacts.

Such contactors are designed to have a nominal working voltage for the solenoid coil, but will pull in at a somewhat lower applied voltage. If the voltage applied to the coil is reduced after the contactor has pulled in, the contacts will remain closed until the applied voltage reaches a drop-out voltage which is appreciably lower than the pull-in voltage.

Such a contactor may be used to switch the supply from a battery to an electric motor, for example a motor for driving a hydraulic pump in a battery-operated vehicle, such as a fork-lift truck.

Many electrically powered fork-lift trucks have hydraulic systems for raising and lowering the forks and for tilting the masts relative to the supporting structure. The hydraulic fluid pressure is created by such hydraulic pump. The driving motor is started and stopped by closing and opening microswitches which are controlled with the opening and closing of a hydraulic control valve. These switches energize the contactor. The hydraulic control valve normally has a spring centering arrangement for returning the valve spool to the neutral position when the control lever is released from an operating position.

One of the problems encountered with this arrangement is that the control valves have a tendency to overshoot sufficiently to cause the switch contacts, and hence the power contactor, to close for a split second and then open again. D.C. motors typically draw a high peak current during initial starting, and the re-opening of the contactor occurs during a time when the peak current is passing through the contactor contacts. This causes intense arcing, resulting in rapid burning of the contacts. Rapid opening and closing of the switch contacts is also frequently initiated by the truck driver by operating the control valve with quick, short lever actuations for moving the fork or mast in small increments for precise positioning.

A further problem is that as the battery becomes discharged during normal use of the vehicle, the battery terminal voltage decreases, and when a heavy current demand is applied to the battery, for example on starting the motor under heavy load conditions, the terminal voltage can fall to a very low value.

Since the contactor coil supply is also taken from the battery, this low terminal voltage on heavy load may be insufficient to hold in the contactor. Hence, when the load is applied, the contactor will begin to drop out, but as the contacts open, the load will be removed from the battery and the terminal voltage will immediately rise. This will cause the contactor to pull in again, once again applying the load to the battery. This action will be repeated continuously. If the contacts continue to open and close on the heavy direct current load in this manner, either of two extremely serious situations can arise. The contacts may weld together, in which case the motor will become uncontrollable. On the other hand, if they continue to open and close cyclically, the contacts will burn away due to the arcing which takes place, and destruction of the contactor can result.

It is desirable to avoid undesirable opening and closing of the contacts of a d.c. operated electromagnetic contactor.

SUMMARY OF THE INVENTION

The present invention is directed to overcoming one or more of the problems as set forth above.

According to the present invention, there is provided a control circuit for a contactor which has at least one pair of contacts and an actuator which is energizable by direct current under the control of a switch to cause closure of the contacts. The control circuit includes switching apparatus for coupling the actuator coil in series with the switching apparatus and in parallel with the contacts. A first timing apparatus operates the switching apparatus to energize the actuator at a predetermined time after closure of the switch. A second timing apparatus prevents a second operation of the switching apparatus until after the elapsing of a further predetermined period of time.

BRIEF DESCRIPTION OF THE DRAWING

The drawing is a schematic diagram of the control circuit of the present invention.

DETAILED DESCRIPTION

Referring to the drawing, a contactor comprises a solenoid coil 1 and contacts 2 and 3 which are closable by energization of the coil 1. A pump motor 4 is connected between a positive battery line 5 and one end of a fuse 6. The other end of the fuse 6 is connected via contacts 7 and 8 of a switch 9 to the contact 2. The contacts 7 and 8 are shunted by a resistor 10. The contact 3 is connected to the negative battery line 11.

The voltage between the lines 5 and 11 will normally be any suitable voltage for the motor 4, for example a selected nominal voltage between 36 and 80 volts.

A line 12 is preferably connected to a tapping on the battery or to the line 5, such that the line 12 is at, say, 36 volts positive with respect to the line 11. The line 12 is connected to one contact 13 of a switch 14, which can be a microswitch which is operable simultaneously with the opening and closing of a hydraulic control valve (not shown). The other contact 15 of the switch 14 is connected to one terminal 16 of the solenoid coil 1.

A control circuit according to the present invention is shown within a chain-dotted rectangle 17. The circuit includes a switching means, such as thyristor 18, the anode of which is connected via a diode 19 to the other terminal 20 of the coil 1. The cathode of the thyristor 18 is connected to a line 21 which is connected via a diode 22 to the line 11. The junction between the anode of the diode 19 and the terminal 20 of the coil 1 is connected via a diode 23 to the contact 2. A "freewheel" circuit comprising a diode 24 and a resistor 25 in series is connected across the coil to allow the coil 1 to controllably collapse its electromagnetic field.

The gate drive circuit for the thyristor 18 includes a capacitor 26, one end of which is connected to the thyristor gate via a diode 27, and the other end of which is connected to the line 21. The junction between the capacitor 26 and the anode of the diode 27 is connected via a resistor 28 and a diode 29 to the contact 15 of the switch 14.

The collector-emitter circuit of a transistor 30 is connected across the capacitor 26. A network comprising a resistor 31 in series with a parallel circuit comprising a capacitor 32 and a resistor 33 is connected at one end to the junction of the diode 29 and the resistor 28 and at the other end to the line 21. The base electrode of the transistor 30 is connected to the junction of the resistor 31 and the parallel capacitance/resistance circuit.

A transient suppression circuit comprising a capacitor 34 and a resistor 35 in parallel is connected between the gate and the cathode of the thyristor 18.

In operation, the switch 14 is initially open, so that no current flows through the coil 1, and the transistor 30 circuit is also de-energized. When a valve lever (not shown) coupled to the switch 14 is operated so that the switch closes, the capacitor 26 charges from the d.c. line 12 via the diode 29 and the resistor 28, and the capacitor 32 charges via the diode 29 and the resistor 31.

After a predetermined time, say 10 milliseconds, as determined by the values of the capacitor 26 and the resistor 28, tne voltage across the capacitor 26, which is applied to the thyristor gate will reach the firing potential of the thyristor 18. The thyristor will conduct, causing the solenoid 1 to close the contacts 2 and 3. The time required to reach the firing potential can be increased by increasing the size of the capacitor 26 or resistor 28 and can be decreased by decreasing the value of capacitor 26 or resistor 28.

The delay before the firing of the thyristor is provided so that any inherent bouncing in the switch 14 will have finished before the solenoid current starts to flow through the contacts 13 and 15. This eliminates the detrimental arcing which would take place at the contacts if they were allowed to open and close rapidly on the solenoid current. It also eliminates voltage transients which would be induced across the coil 1 if repeated interruptions of the coil current due to contact bouncing were allowed to occur.

The closing of the contacts 2 and 3 will take an appreciable time, say 50 milliseconds, after the thyristor 18 has fired. Closing of these contacts will pull the voltage across the thyristor 18 down to a low level determined by the forward voltage of the diode 23 and the voltage drop across the closed contacts. The thyristor will therefore turn off because this low voltage is insufficient to keep the thyristor turned on.

The values of the resistors 31 and 33 and the capacitor 32 are such that the capacitor 32 charges more slowly than the capacitor 26. By this construction, capacitor 26 will charge and fire the thyristor before capacitor 32 charges to turn the transistor on and turn the thyristor gate off. After a predetermined time, say 25 milliseconds, the voltage across the capacitor 32 reaches a level sufficient to cause conduction of the transistor 30. The values of the resistors 28 and 31 are selected such that the potential of the collector of the transistor 30 falls to, say, 0.2 volts when the transistor is fully conducting. This clamps the gate of the thyristor 18, so that if the contacts 2 and 3 re-open immediately after closure, the thyristor 18 cannot conduct to cause them to close again. The clamp will remain on the thyristor gate until the switch 14 has been opened, and sufficient time, say 50 milliseconds, has thereafter elasped for capacitor 32 to discharge through the resistor 33 to a voltage level at which the transistor 30 turns off.

Considering, now, the operation of the circuit if the battery is badly discharged, closure of the contacts 2 and 3, thereby connecting the motor 4 to the battery, will cause the battery voltage to fall to a low level. If this level is so low that the voltage on the line 12 is less than the drop-out voltage of the contactor, the contacts 2 and 3 will open and break the circuit of the contactor coil 1. The clamp will already be on the gate of the thyristor 18, so that even if the line 12 falls to zero volts on closure of the contacts 2 and 3, the thyristor cannot conduct again on re-opening of the contacts.

To summarize, the above-described control circuit has a number of advantages over known contactor control circuits. It prevents the arcing of the contactor contact which would occur if the contacts were to close and open rapidly on a heavy d.c. load. The time constant of the capacitor 26 and associated components prevents the thyristor 18 from firing until a predetermined time after the switch 14 is closed, and hence prevents the solenoid coil current from flowing through the contacts 13 and 15 until any bouncing of those contacts during closure has finished. Arcing of the contacts during closure of the switch 14 is therefore limited and repeated opening and closing of the contacts 2 and 3 is prevented.

The embodiments of the invention in which an exclusive property or privilege is claimed are defined as follows:

1. In a control circuit for a contactor with at least one pair of contacts and an actuator coil which is energizable by direct current under the control of a switch to cause closure of the contacts, the improvement comprising:

switching means coupled in series with the actuator coil and in parallel with the contacts;

first timing means for operating the switching means and energizing the actuator coil a preselected time after closure of the switch and controllably coupling the actuator coil in series with the contacts; and second timing means for preventing a second operation of the switching means until after further predetermined period of time.

2. A control circuit as claimed in claim 1, wherein the switching means includes a thyristor having a gate.

3. A control circuit as claimed in claim 2, wherein the first timing means includes means to apply a triggering signal to the gate of the thyristor, and the second timing means comprises means to remove said triggering signal after a time sufficient for the thyristor to have fired.

4. A control circuit as claimed in claim 2, wherein the first timing means includes a first capacitor which charges following closure of the switch, the voltage across said first capacitor acting as the triggering signal for the gate of the thyristor.

5. A control circuit as claimed in claim 4, wherein the second timing means includes a semiconductor switching device which is operative to short-circuit said first capacitor and remove the triggering signal.

6. A control circuit as claimed in claim 5, wherein the semi-conductor switching device is a transistor having a base and collector-emitter circuit, said collector-emitter circuit being connected across said first capacitor; and wherein the second timing means includes a second capacitor which charges following closure of the switch and controls the base voltage of the transistor.

7. In a control circuit having a power supply having first and second terminals;

a switch having first and second terminals, said first terminal being connected to the first terminal of the power supply; and a contactor having an actuator coil and first and second contacts, a first end of said coil being connected to the second terminal of the switch and a second end of the coil being coupled to the first contact, said second contact being connected to the second terminal of the power supply, the improvement comprising:

a thyristor having an anode, cathode and a gate and being coupled in series with the coil and in parallel with the contacts;

first means connected to the gate for automatically, controllably firing the thyristor and energizing the coil and closing the contacts a preselected time after closing the switch;

second means for turning off the thyristor in response to the contacts being closed; and third means for clamping the gate and preventing a second firing of the thyristor for a preselected time after the initial firing.

8. A control circuit, as set forth in claim 7, wherein the first means includes a capacitor coupled to the switch and gate, said capacitor charging following closure of the switch and developing a voltage signal thereacross, said thyristor firing in response to the gate receiving the voltage signal and the voltage signal reaching a preselected magnitude.

9. A control circuit, as set forth in claim 7, wherein the second means includes a diode having an anode and a cathode, said anode being connected to the second end of the coil, said cathode being connected to the first contact.

10. A control circuit, as set forth in claim 7, wherein the third means includes a transistor having an emitter, base and collector, one of the emitter and collector being coupled to the gate, said transistor clamping the thyristor gate potential to a voltage level below the firing voltage level of the thyristor when the transistor is turned on.

11. A control circuit, as set forth in claim 10, including a capacitor coupled at one end to the base of the transistor and the second terminal of the switch and coupled at the other end to the second terminal of the power supply, said capacitor charging upon closure of the switch and developing a voltage signal thereacross, said transistor being turned on in response to the voltage signal reaching a preselected magnitude.

* * * * *